US006431396B1

(12) United States Patent
Daniels et al.

(10) Patent No.: US 6,431,396 B1
(45) Date of Patent: Aug. 13, 2002

(54) INTERLEAVED ROLL MOUNTED BAGS AND DISPENSERS FOR SAME

(75) Inventors: Mark E. Daniels; Joseph L. Wicherski, both of Redondo Beach, CA (US)

(73) Assignee: The Avantage Group, Inc., Redondo Beach, CA (US)

( * ) Notice: Subject to any disclaimer, the term of this patent is extended or adjusted under 35 U.S.C. 154(b) by 0 days.

(21) Appl. No.: 10/043,635

(22) Filed: Jan. 9, 2002

(51) Int. Cl.[7] ..... A47K 10/24

(52) U.S. Cl. ..... 221/45; 206/554

(58) Field of Search ..... 221/33, 45, 48, 221/51, 63, 281; 206/554, 390

(56) References Cited

U.S. PATENT DOCUMENTS 6,098,836 A * 8/2000 Gottselig ..... 221/45

* cited by examiner

*Primary Examiner*—Kenneth W. Noland
(74) *Attorney, Agent, or Firm*—Beehler & Pavitt; David A. Belasco

(57) ABSTRACT

A series of interleaved roll mounted bags and dispensers for them are described. The bags are folded longitudinally and rolled with an upper portion of each bag located above a lower portion of a succeeding bag. The compact roll of bags is placed in any of a variety of dispensers with the upper end of the outermost bag extending outwardly from the dispenser. As the upper portion of the first bag is pulled from the roll, the bag roll will rotate, presenting the succeeding bag for dispensing after the first bag is removed. In a variant of the invention, the rolled bags are gusseted T-shirt style shopping bags. These T-shirt bags have top and bottom seals, gusseted sides, a U-shaped cutout at the top seam, an open mouth and a pair of bag handles. Variations of the dispenser include a simple tray with an open top, and various configurations involving one or more restraining members. The dispenser may be tilted to control movement of the bag roll. In other variants, the dispenser includes a bag guide extending from the inner surface of a front restraining member to the inner surface of a rear restraining member. The bag guide may be curved, V-shaped, a rounded U-shape or a square U-shape. The dispenser may be attached to a surface with screws or nails extending through openings in the supports for the dispenser or glue tabs may be used for attachment. Weighted feet are used to secure the dispenser in a final variant.

21 Claims, 8 Drawing Sheets

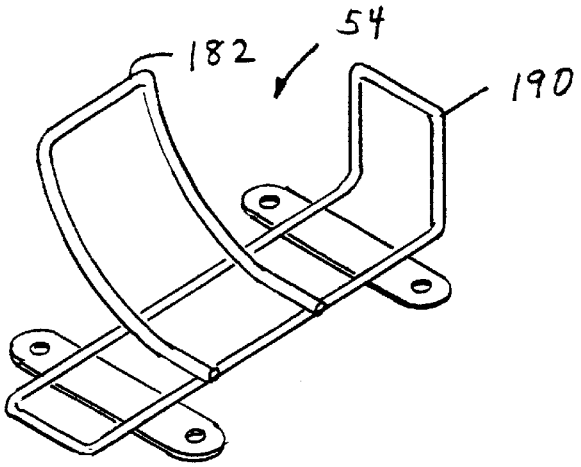
Fig. 8
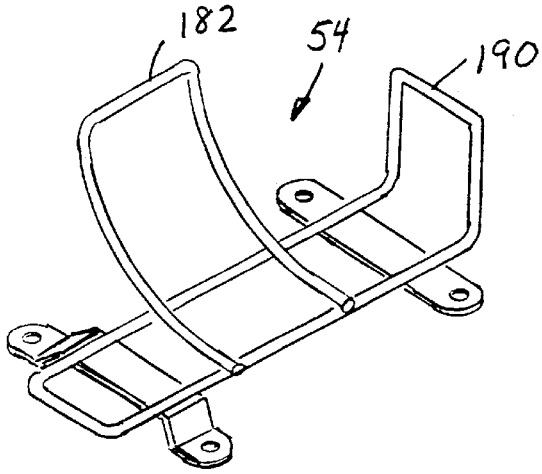
Fig 9
Fig 10
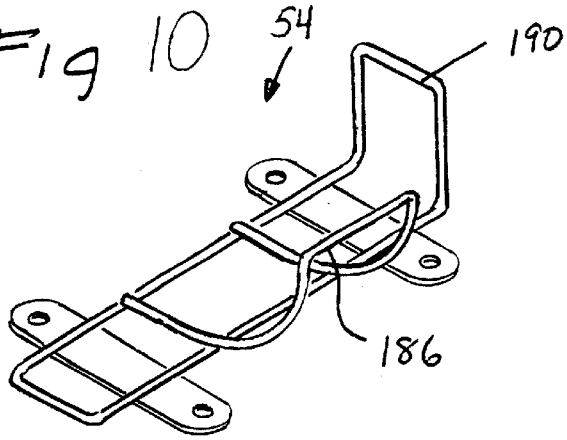
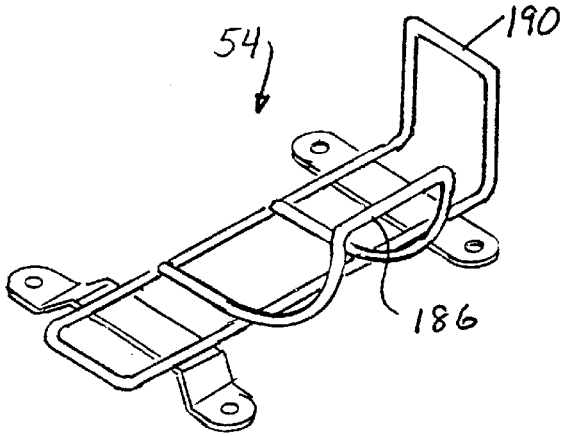
Fig 11

Fig. 12
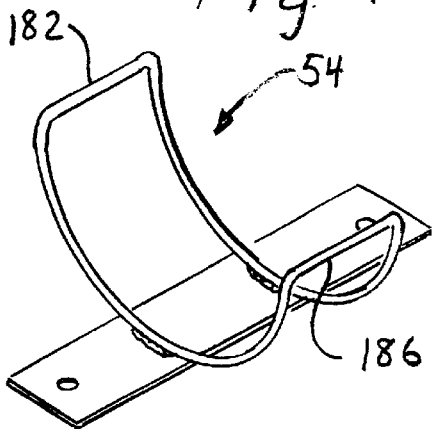
Fig 13
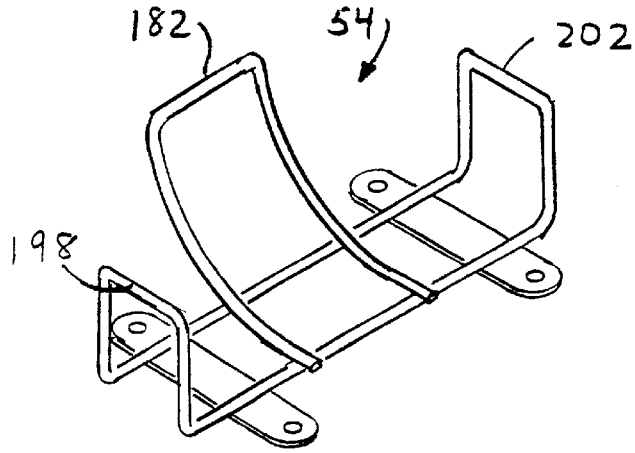
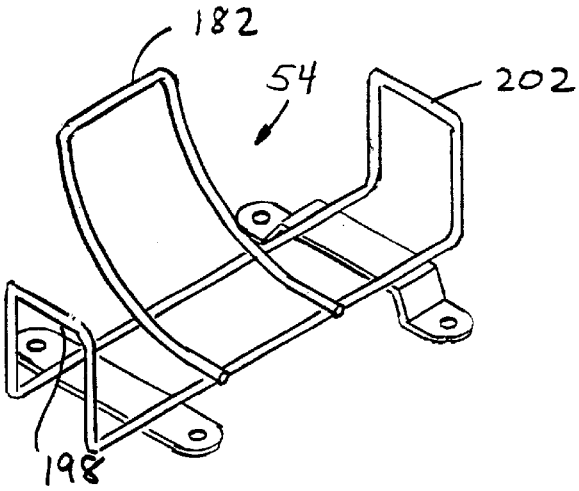
Fig 14
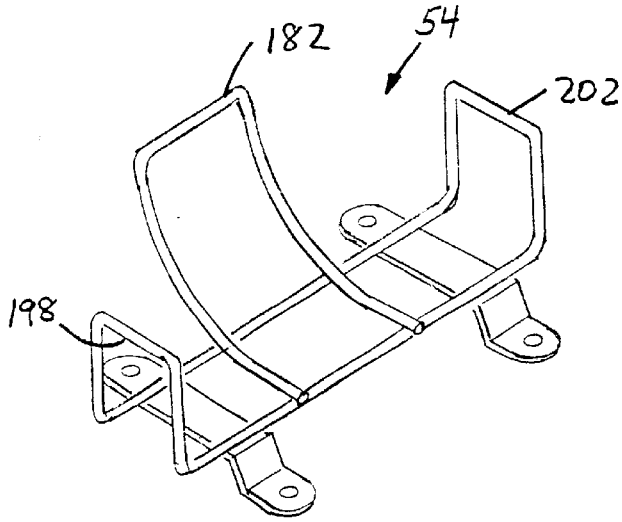
Fig. 15

Fig 16
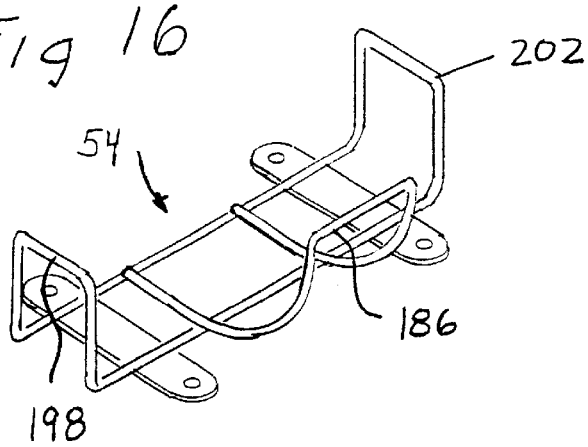
Fig 17
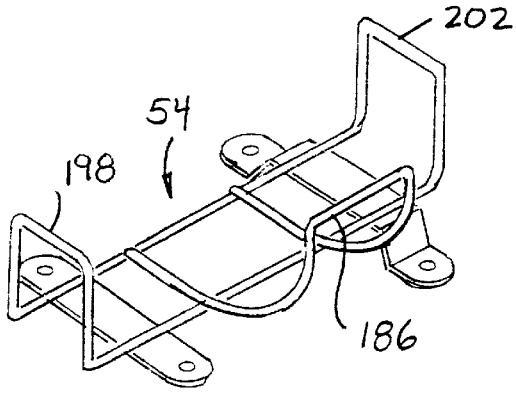
Fig 18
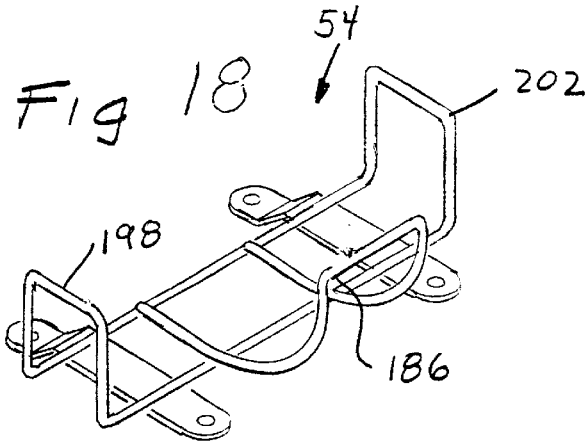
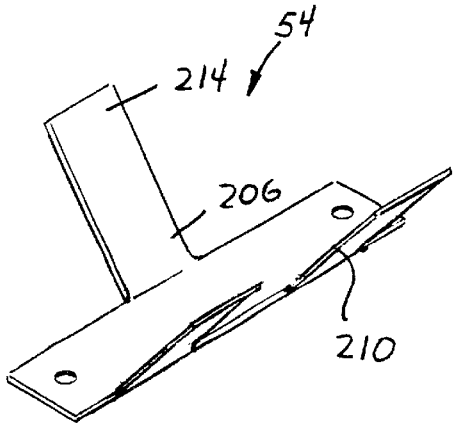
Fig 19

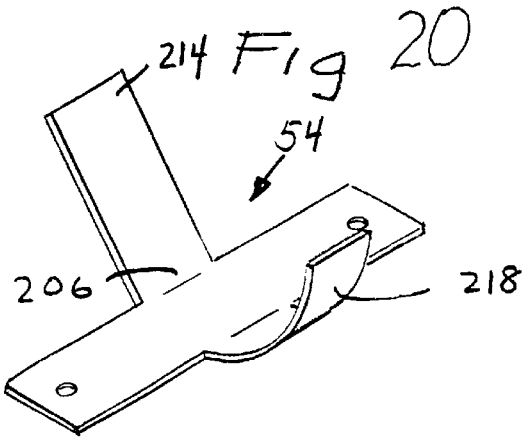
Fig 20
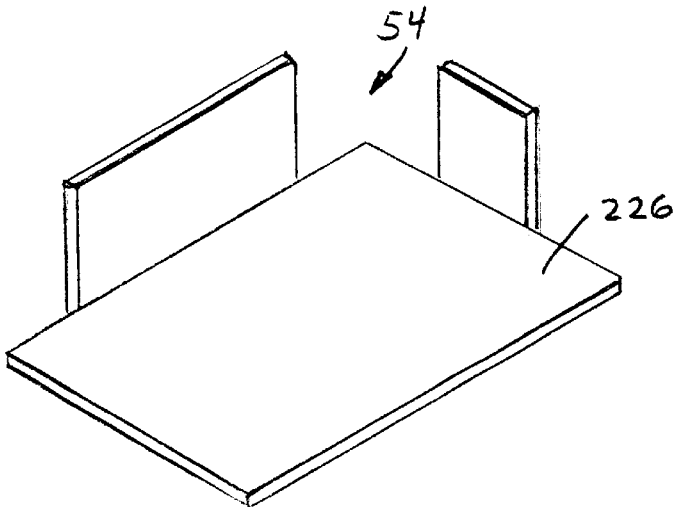
Fig 22
Fig. 21
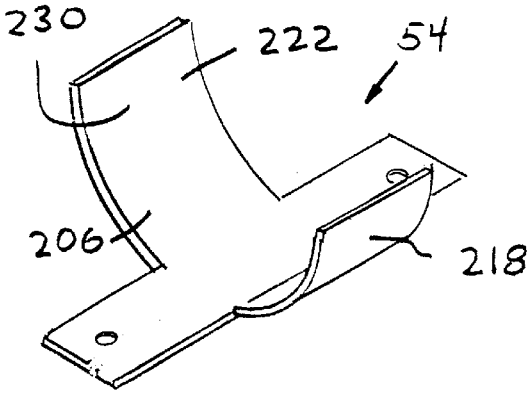
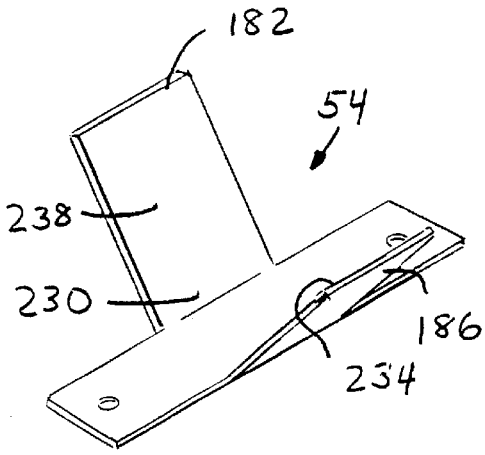
Fig 23
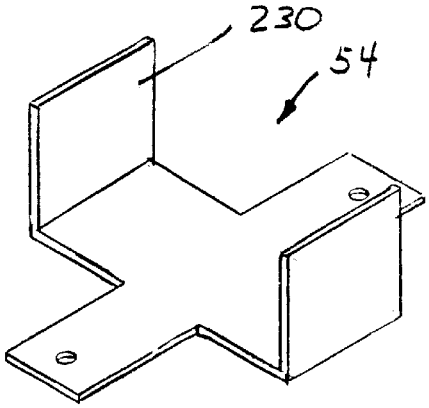
Fig. 24

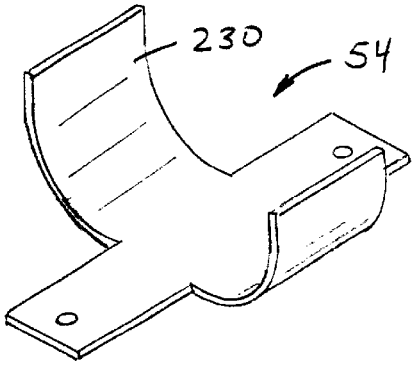
Fig 25
Fig 26
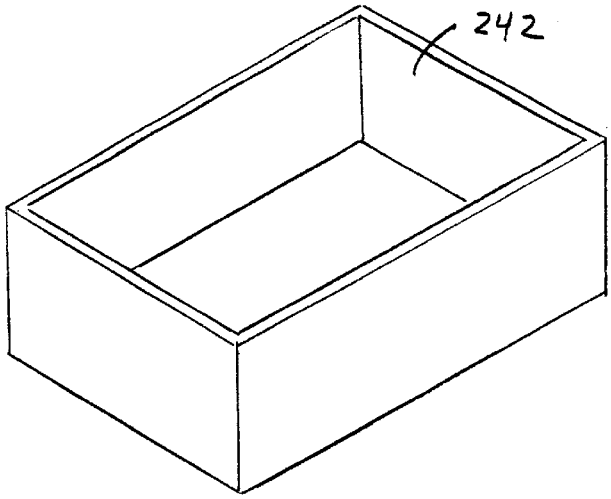
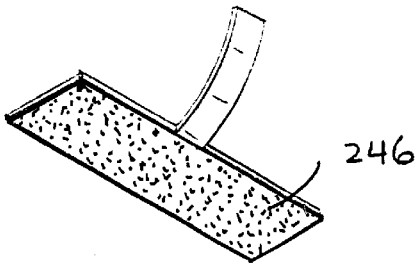
Fig 27
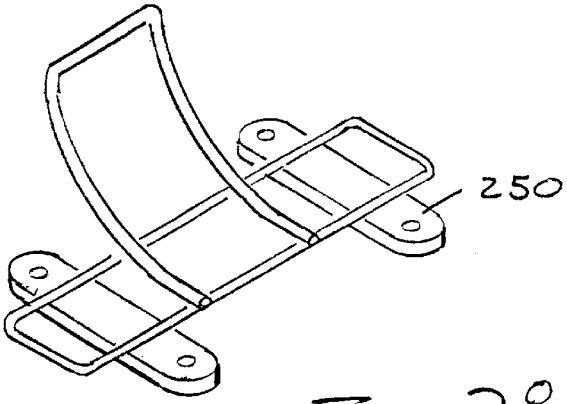
Fig 28
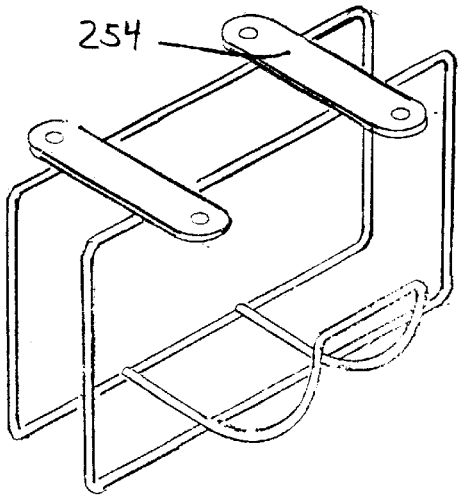
Fig 29

INTERLEAVED ROLL MOUNTED BAGS AND DISPENSERS FOR SAME

FIELD OF INVENTION

The invention pertains to plastic shopping bags and means for storing and dispensing such bags. More particularly, the invention relates to expandable plastic film shopping bags designed for roll dispensing.

BACKGROUND OF THE INVENTION

Plastic shopping bags are commonly used in supermarkets, department stores and similar applications. These bags have advantages in that they are relatively inexpensive to produce, provide substantial carrying capacity and may include easily used handles. When the bags are produced in larger, more heavy-duty sizes, several problems occur.

First, storage and retrieval of the bags becomes difficult as the bags become larger. Typical packaging of the bags involves storing them in flat packs in paperboard or corrugated cartons. These containers require substantial shelf space and the containers tend to slide on the shelves when the bags are removed from them. Often the bag boxes are placed near the floor, requiring excessive bending on the part of a cashier filing the bags. Such bending motions also require the cashier to be unavailable to watch the customer during checkout. Second, when stored in flat packages, the bags tend to slide over one another making retrieval from the storage container difficult. Third, the cartons in which the bags are stored are disposable and expensive to produce.

It is an objective of the invention to provide a means for dispensing large size shopping bags while maximizing the use of limited checkout counter space. It is a further objective to prevent the need for checkout personnel to bend over to reach for the shopping bags. It is another objective of the invention to allow the checkout personnel to maintain eye contact with customers while reaching for shopping bags. It is still another objective to provide for bag dispensers that can be mounted in a variety of different ways to suit the needs of particular checkout stations. Finally, it is an objective of the invention to provide dispensers that can be easily and quickly loaded with shopping bags minimizing the need for disposing of any bag boxes or containers.

Various designs have been developed for roll mounted bags and dispensers for such bags, incorporating a number of different technologies. U.S. Pat. No. 5,752,666 issued to Simhaee discloses a roll of plastic bags wound on a core in a star-sealed configuration for use with a dispenser having opposing tracks in which the roll is supported. The dispenser has a separating tongue for enabling individual bags to be separated from the roll. Separation lines are provided between adjacent bags, a slot in each separation line being engageable by the tongue within the dispenser so that individual bags may be dispensed from the roll one at a time.

U.S. Pat. No. 5,556,019 issued to Morris, describes a bag separator and dispenser for use with bags wound on a core and separated by perforation lines at each end of the bags. The perforation lines include a slot that is collinear with the perforations and is used to engage a separator projection. The projection enters the slot as the bags are pulled from the roll. The dispenser includes two braking devices to control the removal of bags from the roll, a braking bar underneath the roll of bags and a pair of fingers that are attached to the channel for the core and are designed to engage the core as the number of bags on the roll decreases.

U.S. Pat. No. 5,135,134, issued to Dancy discloses a deformable plastic bag dispenser for a continuous roll of plastic bags. The dispenser is cylindrical in shape and includes a longitudinal slot for dispensing the bags. Adjacent bags on the roll are attached by a perforated tear line. The dispenser is deformable to allow the operator to grip the roll by squeezing the dispenser, preventing further rotation of the roll, and allowing a bag to be removed from the roll.

U.S. Pat. No. 4,793,539 issued to Haenni et al. describes a through-counter dispensing system for plastic bags. A dispensing nozzle is fitted to a hole in a countertop. The bags are wound on rolls mounted to racks beneath the counter. The nozzle includes frictional elements in the form of a zigzag slot designed to allow a first bag to be torn from a subsequent bag as the first bag is pulled through the slot. An enlarged loading opening is provided at one side of the slot to facilitate loading of the first bag into the nozzle for dispensing.

U.S. Pat. No. 5,509,570 issued to DeMatteis is directed to a dispenser of plastic bags. The bags are stacked in a position for mouth forward dispensing. The bags are folded at two locations; the first is a fold at the straps' juncture with the rest of the bag and the second is a fold closer to the bottom, of the bag (about half-way) at a location that permits each fold, to lie against the front and rear walls of the carton. This helps keep the stack of plastic bags in position within the carton between the front and rear walls. The first fold results in the strap being folded to extend away from the bag mouth cutout and toward the second fold. The bags are thus positioned to expose the top-most mouth in the stack, which is in a forward-most position immediately accessible via the cutout.

U.S. Pat. No. 6,305,572, issued to Daniels et al., the present inventors, discloses interleaved roll mounted bags and dispenser similar to the present invention, however, lacking the variety of dispensers described in the present invention.

While other variations exist, the above-described designs for roll and carton mounted bags and dispensers are typical of those encountered in the prior art. While some of the objectives of the present invention are disclosed in the prior art, none of the inventions found include all of the requirements identified.

SUMMARY OF THE INVENTION

The present invention addresses may of the deficiencies of shopping bag and dispenser combination inventions and satisfies all of the objectives described above.

An interleaved roll mounted bag and dispenser combination providing the desired features may be constructed from the following components. A plurality of plastic shopping bags is provided. Each of the bags has first and second parallel linear side edges, a top edge and a bottom edge. The bags are folded along a vertical axis between the first and second parallel linear side edges. The folded bags are interleaved upon each other so that an upper portion of each bag rests upon a lower portion of a subsequent bag. The interleaved bags are rolled to form a compact roll from which the bags are dispensed.

A dispenser is provided. The dispenser includes a receptacle that constrains movement of the compact bag roll during dispensing of the interleaved bags. The compact bag roll is located within the dispenser with an outside bag of the roll extendable outwardly from the dispenser. When the compact bag roll is located within the dispenser with the upper portion of the outside bag accessible for withdrawal from the dispenser, the bags may be serially withdrawn from the roll starting with the outside bag of the roll.

In a variant of the invention, each of the shopping bags, commonly known as a T-shirt style bag includes a front panel, a rear panel, two front gusset panels and two rear gusset panels. The front panel has first and second parallel linear side edges, a top edge and a bottom edge. The rear panel has first and second parallel linear side edges, a top edge and a bottom edge. The two front gusset panels are of a first predetermined dimension. Each front gusset panel has a top edge, a bottom edge, first and second parallel side edges and is joined at the first side edge to one of the linear side edges of the front panel and extends from the top edge of the front panel to the bottom edge of the front panel.

The two rear gusset panels are of the first predetermined dimension. Each rear gusset panel has a top edge, a bottom edge, first and second parallel side edges and is joined at the first side edge to one of the linear side edges of the rear panel and extends from the top edge of the rear panel to the bottom edge of the rear panel. Each front gusset panel is also joined to a respective one of the rear gusset panels at the second side edge. Each of the front and rear gusset panels is folded inwardly relative to the front and the rear panels.

The top edges of the front panel, the rear panel, the front gusset panels and the rear gusset panels terminate in an upper seam. The bottom edges of the front panel, the rear panel, the front gusset panels and the rear gusset panels terminate in a lower seam. The lower seam is perpendicular to the linear side edges of the front and rear panels.

A U-shaped cut-out is provided. The U-shaped cut-out is located in an upper portion of the bag and commences at a first point along the upper seam. The point is spaced inwardly from the first linear side edge and extends to a second point along the upper seam spaced inwardly from the second linear side edge. The cut-out extends downwardly toward the lower seam, forming an open mouth and a pair of bag handles.

In a further variant, the dispenser includes means for securing the dispenser to a surface. In still a further variant, the receptacle has at least one rear restraining member. In another variant the receptacle has at least one front restraining member. In yet another variant the receptacle has at least one rear restraining member and at least one side restraining member. In still another variant of the invention, the receptacle is mounted so as to tilt toward the at least one side restraining member.

In a further variant, the receptacle has at least one front restraining member and at least one side restraining member. In yet a further variant, the receptacle is mounted so as to tilt toward the at least one side restraining member. In still a further variant, the receptacle has at least one front restraining member and at least one rear restraining member.

In still another variant of the invention, the receptacle has at least one rear restraining member and first and second side restraining members. In yet another variant, the receptacle is mounted so as to tilt toward either of the first and second side restraining members. In a further variant, the receptacle is mounted so as to tilt toward the rear restraining member.

In still a further variant, the receptacle has a front restraining member and first and second side restraining members. In yet a further variant of the invention, the receptacle is mounted so as to tilt toward either of the first and second side restraining members. In still a further variant, the receptacle is mounted so as to tilt toward the front restraining member.

In another variant of the invention, the receptacle is a cradle; the cradle has either of an angled front restraining member and an angled rear restraining member. In yet another variant, the receptacle is a cradle, the cradle having either of a curved front restraining member and a curved rear restraining member. In still another variant, the receptacle is constructed of material selected from the group comprising: metal, wood, plastic, fiberglass and paperboard.

In a further variant of the invention, the receptacle further comprises a bag roll guide, the guide extending from an inner surface of the front restraining member to an inner surface of the rear restraining member. In a final variant, the bag roll guide is of the form selected from the group comprising: curved, V-shaped, rounded U-shaped, and square U-shaped.

Further variants of the invention include a tray-like dispenser, a dispenser with glue tabs for mounting to a surface, a dispenser with weighted mounting feet, and a dispenser designed to be mounted under a counter.

DESCRIPTION OF THE DRAWINGS

FIG. 8 is a perspective view of a fifth embodiment of a dispenser for the rolled interleaved bags including rear and side restraining members;

FIG. 9 is a perspective view of the FIG. 8 embodiment with a mounting tilting toward the side restraining member;

FIG. 10 is a perspective view of a seventh embodiment of a dispenser for the rolled interleaved bags including front and side restraining members;

FIG. 11 is a perspective view of the FIG. 10 embodiment with a mounting tilting toward the side restraining member;

FIG. 12 is a perspective view of an eighth embodiment of a dispenser for the rolled interleaved bags including front and rear restraining members;

FIG. 13 is a perspective view of a ninth embodiment of a dispenser for the rolled interleaved bags including rear and first and second side restraining members;

FIG. 14 is a perspective view of the FIG. 13 embodiment with a mounting tilting toward a side restraining member;

FIG. 15 is a perspective view of the FIG. 13 embodiment with a mounting tilting toward the rear restraining member;

FIG. 16 is a perspective view of a tenth embodiment of a dispenser for the rolled interleaved bags including front and first and second side restraining members;

FIG. 17 is a perspective view of the FIG. 16 embodiment with a mounting tilting toward a side restraining member;

FIG. 18 is a perspective view of the FIG. 16 embodiment with a mounting tilting toward the front restraining member;

FIG. 19 is a perspective view of an eleventh embodiment of a dispenser for the rolled interleaved bags in the form of a cradle including two front and one rear angled restraining members;

FIG. 20 is a perspective view of the FIG. 19 embodiment including a curved front restraining members and an angled rear restraining member;

FIG. 21 is a perspective view of the FIG. 19 embodiment of a dispenser for the rolled interleaved bags in the form of a cradle including curved front and rear restraining members with a bag roll guide at the inner surfaces of the restraining members;

FIG. 22 is a perspective view of a twelfth embodiment of a dispenser for the rolled interleaved bags in the form of a tray including rear and side restraining members;

FIG. 23 is a perspective view of the FIG. 19 embodiment including front and rear angled restraining members with a bag roll guide at the inner surfaces of the restraining members;

FIG. 24 is a perspective view of the FIG. 19 embodiment including front and rear squared restraining members and bag roll guide;

FIG. 25 is a perspective view of the FIG. 19 embodiment including front and rear curved restraining members and bag roll guide;

FIG. 26 is a perspective view of a thirteenth embodiment of a dispenser for the rolled interleaved bags in the form of a tray including front, rear and first and second side restraining members;

FIG. 27 is a perspective view of the FIG. 7 embodiment including adhesive disposed upon a lower surface of the dispenser;

FIG. 28 is a perspective view of the FIG. 6 embodiment with the addition of weighted feet for mounting the dispenser; and FIG. 29 is a perspective view of the FIG. 7 embodiment with the addition of features that permit it to be mounted under a counter.

DETAILED DESCRIPTION OF THE PREFERRED EMBODIMENT

Figure 2:
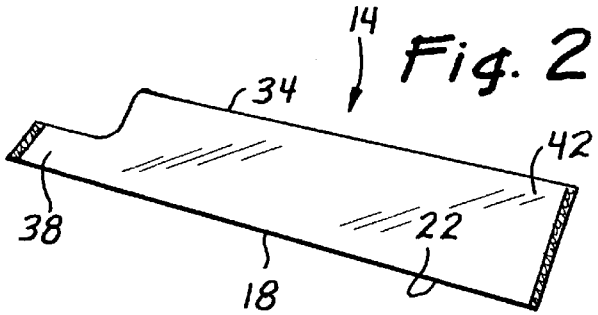
FIG. 2 is a perspective view of the FIG. 1 bag folded in half longitudinally.
Figure 1:
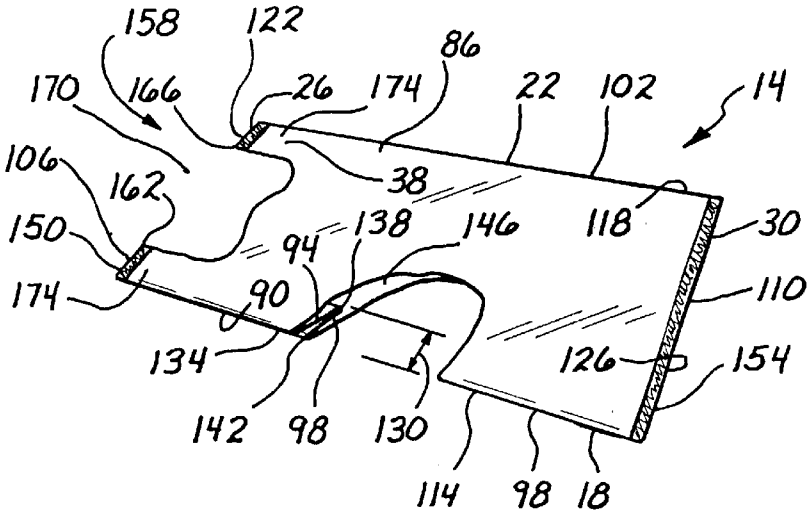
FIG. 1 is a partially cutaway perspective view of a typical T-shirt style merchandise bag illustrating a gusseted side edge.
Figure 3:
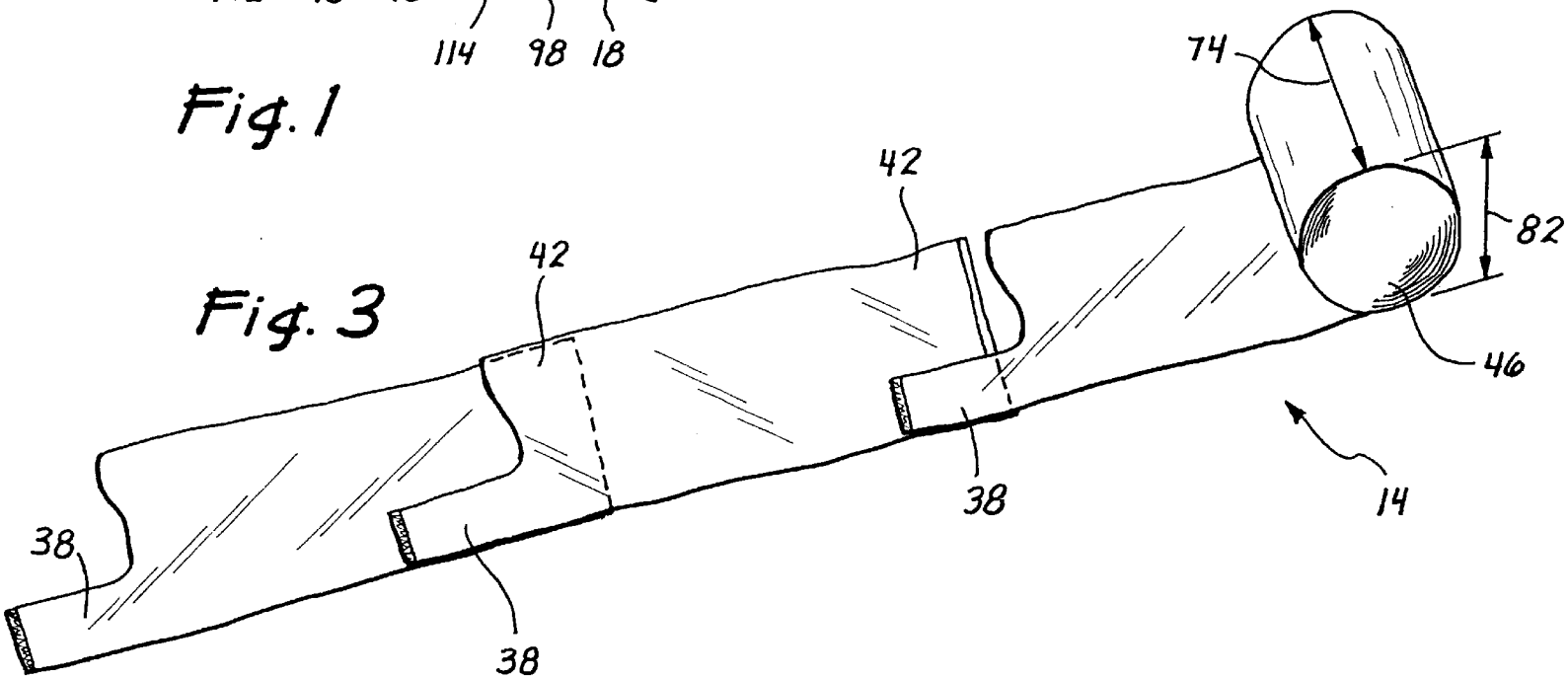
FIG. 3 is a perspective view of a series of the bags illustrated in FIG. 2, interleaved and rolled together into a compact roll.

FIGS. 1–29 illustrate an interleaved roll mounted bag and dispenser combination 10 providing the-desired features that may be constructed from the following components. As illustrated in FIGS. 1–3, a plurality of plastic shopping bags 14 is provided. As shown in FIG. 1, each of the bags 14 has first 18 and second 22 parallel linear side edges, a top edge 26 and a bottom edge 30. As illustrated in FIG. 2, the bags 14 are folded along a vertical axis 34 between the first 18 and second 22 parallel linear side edges. As shown in FIG. 3, the folded bags 14 are interleaved upon each other so that an upper portion 38 of each bag 14 rests upon a lower portion 42 of a subsequent bag 14. The interleaved bags 14 are rolled to form a compact roll 46 from which the bags 14 are dispensed.

Figure 4:
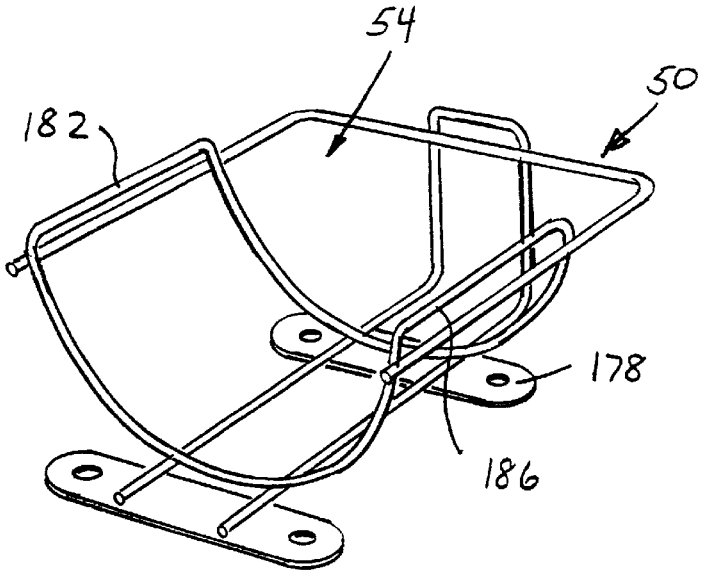
FIG. 4 is a perspective view of a first embodiment of a dispenser for the rolled interleaved bags including means for attaching the dispenser to a surface.
Figure 5:
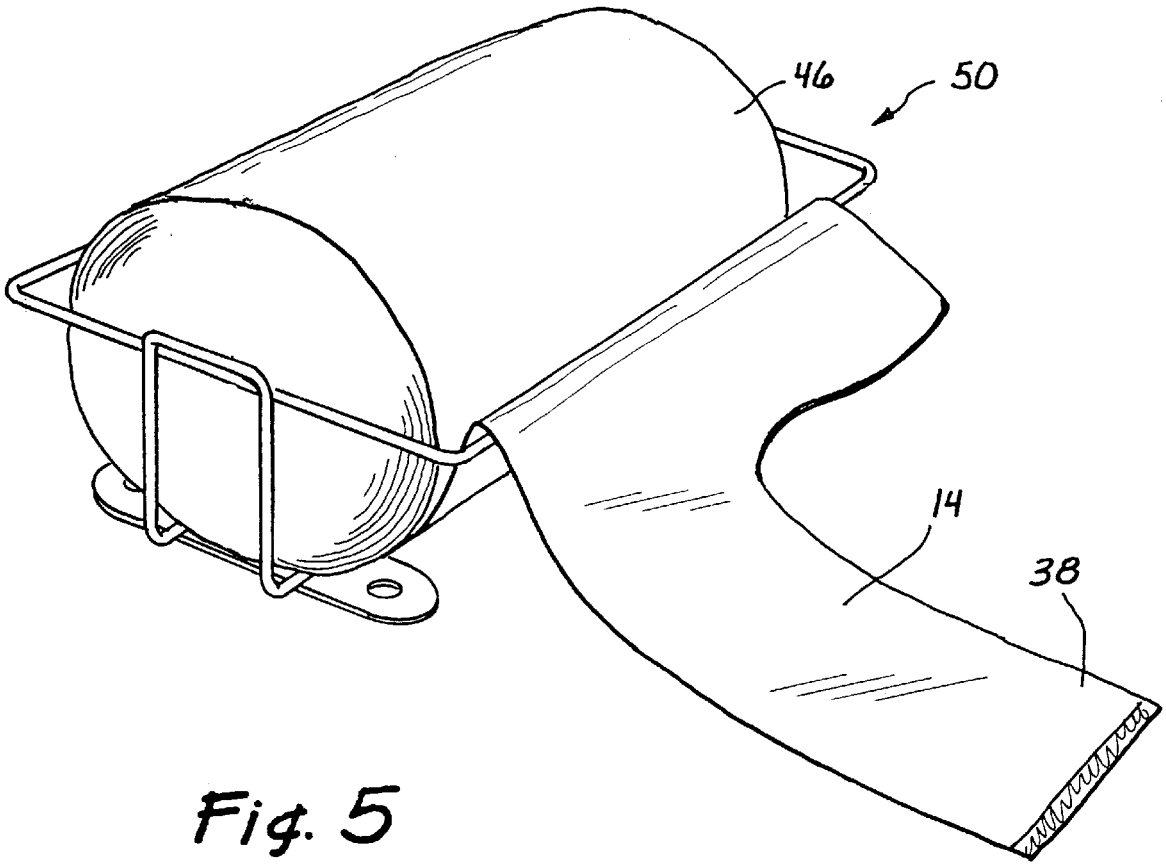
FIG. 5 is a perspective view of a second embodiment of a dispenser with the FIG. 3 roll of interleaved bags installed in which the bags are rolled from the lower end to the upper end.

As illustrated in FIGS. 4 and 5, a dispenser 50 is provided. The dispenser 50 includes a receptacle 54 that constrains movement of the compact roll during dispensing of the interleaved bags. The compact bag roll 46 is located within the dispenser 50 with an outside bag 14 of the roll 46 extendable outwardly from the dispenser 50. When the compact bag roll 46 is located within the dispenser 50 with the upper portion 38 of the outside bag 14 accessible for withdrawal from the dispenser 50, the bags 14 may be serially withdrawn from the roll 46 starting with the outside bag 14 of the roll 46.

In a variant of the invention, illustrated in FIGS. 1 and 2, each of the shopping bags 14, commonly known as a T-shirt style bag includes a front panel 86, a rear panel 90, two front gusset panels 94 and two rear gusset panels 98. The front panel 86 has first 98 and second 102 parallel linear side edges, a top edge 106 and a bottom edge 110. The rear panel 90 has first 114 and second 118 parallel linear side edges, a top edge 122 and a bottom edge 126. The two front gusset panels 94 are of a first predetermined dimension 130. Each front gusset panel 94 has a top edge (not shown), a bottom edge (not shown), first 134 and second 138 parallel side edges and is joined at the first side edge 134 to one of the linear side edges 98, 102 of the front panel 86 and extends from the top edge 106 of the front panel 86 to the bottom edge 110 of the front panel 86.

The two rear gusset panels 98 are of the first predetermined dimension 130. Each rear gusset panel 98 has a top edge (not shown), a bottom edge (not shown), first 142 and second 146 parallel side edges and is joined at the first side edge 142 to one of the linear side edges 114, 118 of the rear panel 90 and extends from the top edge 122 of the rear panel 90 to the bottom edge 126 of the rear panel 90. Each front gusset panel 94 is also is joined to a respective one of the rear gusset panels 98 at the second side edge 146. Each of the front 94 and rear 98 gusset panels is folded inwardly relative to the front 86 and the rear 90 panels.

The top edges 106, 122 of the front panel 86, the rear panel 90, the front gusset panels 94 and the rear gusset panels 98 terminate in an upper seam 150. The bottom edges 110, 126 of the front panel 86, the rear panel 90, the front gusset panels 94 and the rear gusset panels 98 terminate in a lower seam 154. The lower seam 154 is perpendicular to the linear side edges 98, 102, 114, 118 of the front 86 and rear 90 panels.

A U-shaped cut-out 158 is provided. The U-shaped cut-out 158 is located in an upper portion 38 of the bag 14 and commences at a first point 162 along the upper seam 150. The first point 162 is spaced inwardly from the first linear side edge 98, 114 and extends to a second point 166 along the upper seam 150 spaced inwardly from the second linear side edge 102, 118. The cut-out 158 extends downwardly toward the lower seam 154, forming an open mouth 170 and a pair of bag handles 174.

Figure 6:
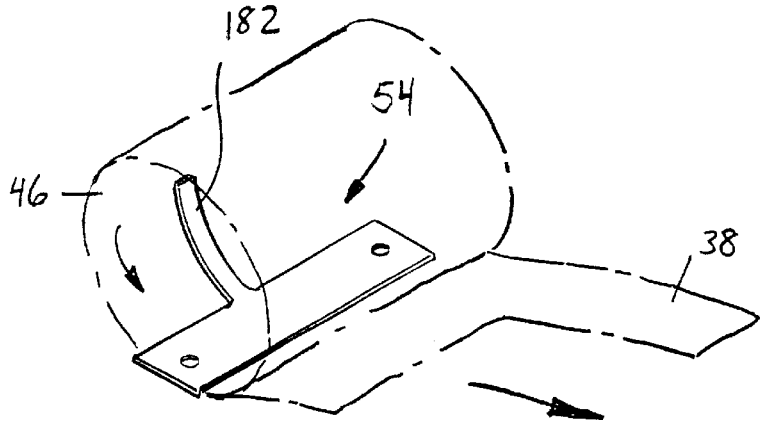
FIG. 6 is a perspective view of a third embodiment of a dispenser for the rolled interleaved bags including a rear restraining member.
Figure 7:
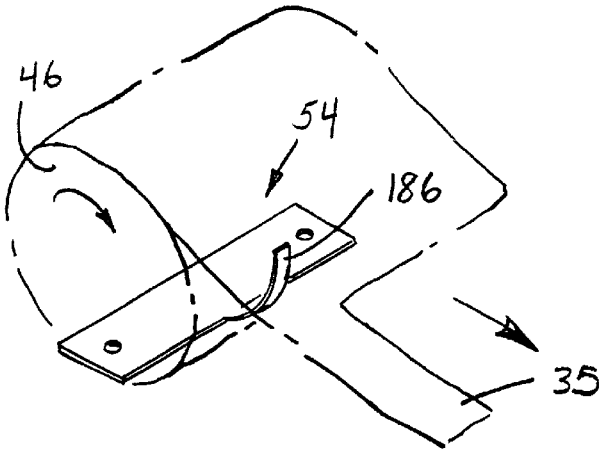
FIG. 7 is a perspective view of a fourth embodiment of a dispenser for the rolled interleaved bags including a front restraining member.

In a further variant, as illustrated in FIGS. 4 and 5, the dispenser 50 includes means 178 for securing the dispenser 50 to a surface (not shown). In still a further variant, as illustrated in FIG. 6, the receptacle 54 has at least one rear restraining member 182. In another variant the receptacle 54, as illustrated in FIG. 7, has at least one front restraining member 186. In yet another variant, as illustrated in FIG. 8, the receptacle 54 has at least one rear restraining member 182 and at least one side restraining member 190. In still another variant, as illustrated in FIG. 9, of the invention, the receptacle 54 is mounted so as to tilt toward the at least one side restraining member 190.

In a further variant, as illustrated in FIG. 10, the receptacle has at least one front restraining member 186 and at least one side restraining member 190. In yet a further variant, as illustrated in FIG. 11, the receptacle 54 is mounted so as to tilt toward the at least one side restraining member 190. In still a further variant, as illustrated in FIG. 12, the receptacle 54 has at least one front restraining member 186 and at least one rear restraining member 182.

In still another variant of the invention, as illustrated in FIG. 13, the receptacle 54 has at least one rear restraining member 182 and first 198 and second 202 side restraining members. In yet another variant, as illustrated in FIG. 14, the receptacle 54 is mounted so as to tilt toward either of the first 198 and second 202 side restraining members. In a further variant, as illustrated in FIG. 15, the receptacle 54 is mounted so as to tilt toward the rear restraining member 182.

In still a further variant, as illustrated in FIG. 16, the receptacle 54 has a front restraining member 186 and first 198 and second 202 side restraining members. In yet a further variant of the invention, as illustrated in FIG. 17, the receptacle 54 is mounted so as to tilt toward either of the first 198 and second 202 side restraining members. In still a further variant, as illustrated in FIG. 18, the receptacle 54 is mounted so as to tilt toward the front restraining member 182.

In another variant of the invention, as illustrated in FIG. 19, the receptacle 54 is a cradle 206; the cradle 206 has either of an angled front restraining member 210 and an angled rear restraining member 214. In yet another variant, as illustrated in FIG. 20, the receptacle 54 is a cradle 206, the cradle having either of a curved front restraining member 218 and a curved rear restraining member 222. In still another variant, as illustrated in FIG. 22, the receptacle 54 is constructed of material 226 selected from the group comprising: metal, wood, plastic, fiberglass and paperboard.

In a further variant of the invention, as illustrated in FIG. 23, the receptacle 54 further comprises a bag roll guide 230, the guide 230 extending from an inner surface 234 of the front restraining member 194 to an inner surface 238 of the rear restraining member 186. In another variant, as illustrated in FIGS. 21, 23, 24 and 25, the bag roll guide 230 is of the form selected from the group comprising: curved, V-shaped, rounded U-shaped, and square U-shaped.

Further variants of the invention, as illustrated in FIGS. 26–29, include a tray-like dispenser 242, a dispenser with glue tabs for mounting to a surface 246, a dispenser with weighted mounting feet 250, and a dispenser designed to be mounted under a counter 254.

The interleaved roll mounted bag and dispenser combination 10 has been described with reference to particular embodiments. Other modifications and enhancements can be made without departing from the spirit and scope of the claims that follow.

What is claimed is:

1. A combination of rolled plastic shopping bags and dispenser therefore comprising:

a plurality of plastic shopping bags, each of said bags having first and second parallel linear side edges, a top edge and a bottom edge;

said bags being folded along a vertical axis between the first and second parallel linear side edges;

said folded bags being interleaved upon each other so that an upper portion of each bag rests upon a lower portion of a subsequent bag;

said interleaved bags being rolled to form a compact roll from which the bags are dispensed;

a dispenser, said dispenser comprising:

a receptacle, said receptacle constraining movement of the compact roll during dispensing of said interleaved bags;

said compact bag roll being disposed within the dispenser with an outside bag of the roll being extendable outwardly from said dispenser; and whereby, when the compact bag roll is disposed within the dispenser with the upper portion of the outside bag being accessible for withdrawal from the dispenser, the bags may be serially withdrawn from the roll starting with the outside bag of the roll.

2. A combination of rolled plastic shopping bags and dispenser therefore as described in claim 1, wherein each shopping bag, commonly known as a T-shirt style bag comprises:

a front panel, said front panel having first and second parallel linear side edges, a top edge and a bottom edge;

a rear panel said rear panel having first and second parallel linear side edges, a top edge and a bottom edge;

two front gusset panels of a first predetermined dimension, each front gusset panel having a top edge, a bottom edge, first and second parallel side edges and being joined at said first side edge to one of the linear side edges of the front panel and extending from the top edge of the front panel to the bottom edge thereof;

two rear gusset panels of the first predetermined dimension, each rear gusset panel having a top edge, a bottom edge, first and second parallel side edges and being joined at said first side edge to one of the linear side edges of the rear panel and extending from the top edge of the front panel to the bottom edge thereof;

each front gusset panel also being joined to a respective one of said rear gusset panels at said second side edge;

each of the front and rear gusset panels being folded inwardly relative to the front and the rear panel;

the top edges of the front panel, the rear panel, the front gusset panels and the rear gusset panels terminating in an upper seam;

the bottom edges of the front panel, the rear panel, the front gusset panels and the rear gusset panels terminating in a lower seam, said lower seam being perpendicular to the linear side edges of the front and rear panels; and a U-shaped cut-out, said U-shaped cut-out being disposed in an upper portion of the bag and commencing at a first point along the upper seam spaced inwardly from said first linear side edge and extending to a second point along the upper seam spaced inwardly from said second linear side edge, said cut-out extending downwardly toward the lower seam, thereby forming an open mouth and a pair of bag handles.

3. A combination rolled shopping bag pack and dispenser as described in claim 1, wherein the dispenser further comprises means for securing said dispenser to a surface.

4. A combination rolled shopping bag pack and dispenser as described in claim 1, wherein the receptacle has at least one rear restraining member.

5. A combination rolled shopping bag pack and dispenser as described in claim 1, wherein the receptacle has at least one front restraining member.

6. A combination rolled shopping bag pack and dispenser as described in claim 1, wherein the receptacle has at least one rear restraining member and at least one side restraining member.

7. A combination rolled shopping bag pack and dispenser as described in claim 6, wherein the receptacle is mounted so as to tilt toward the at least one side restraining member.

8. A combination rolled shopping bag pack and dispenser as described in claim 1, wherein the receptacle has at least one front restraining member and at least one side restraining member.

9. A combination rolled shopping bag pack and dispenser as described in claim 8, wherein the receptacle is mounted so as to tilt toward the at least one side restraining member.

10. A combination rolled shopping bag pack and dispenser as described in claim 1, wherein the receptacle has at least one front restraining member and at least one rear restraining member.

11. A combination rolled shopping bag pack and dispenser as described in claim 1, wherein the receptacle has at least one rear restraining member and first and second side restraining members.

12. A combination rolled shopping bag pack and dispenser as described in claim 11, wherein the receptacle is mounted so as to tilt toward either of the first and second side restraining members.

13. A combination rolled shopping bag pack and dispenser as described in claim 11, wherein the receptacle is mounted so as to tilt toward the rear restraining member.

14. A combination rolled shopping bag pack and dispenser as described in claim 1, wherein the receptacle has a front restraining member and first and second side restraining members.

15. A combination rolled shopping bag pack and dispenser as described in claim 14, wherein the receptacle is mounted so as to tilt toward either of the first and second side restraining members.

16. A combination rolled shopping bag pack and dispenser as described in claim 14, wherein the receptacle is mounted so as to tilt toward the front restraining member.

17. A combination rolled shopping bag pack and dispenser as described in claim 1, wherein the receptacle is a cradle, said cradle having either of an angled front restraining member and an angled rear restraining member.

18. A combination rolled shopping bag pack and dispenser as described in claim 1, wherein the receptacle is a cradle, said cradle having either of a curved front restraining member and a curved rear restraining member.

19. A combination rolled shopping bag pack and dispenser as described in claim 1 wherein the receptacle is constructed of material selected from the group comprising:

metal, wood, plastic, fiberglass and paperboard.

20. A combination rolled shopping bag pack and dispenser as described in claims 10, 17 and 18, wherein the receptacle further comprises a bag roll guide, said guide extending from an inner surface of the front restraining member to an inner surface of the rear restraining member.

21. A combination rolled shopping bag pack and dispenser as described in claim 20, wherein the bag roll guide is of the form selected from the group comprising:

curved, V-shaped, rounded U-shaped, and square U-shaped.

* * * * *